US007274902B2

(12) United States Patent
Holstun et al.

(10) Patent No.: US 7,274,902 B2
(45) Date of Patent: Sep. 25, 2007

(54) PRINTER TRANSFER MEMBER

(75) Inventors: Clayton L. Holstun, San Marcos, CA (US); Vincent Gerard Heesen, Jr., San Diego, CA (US); Mark T. Aronhime, Rehovot (IL); Amiran Lavon, Rehovot (IL); Stanley J. Kozmiski, Escondido, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 79 days.

(21) Appl. No.: 11/093,466

(22) Filed: Mar. 30, 2005

(65) Prior Publication Data

US 2006/0222421 A1 Oct. 5, 2006

(51) Int. Cl.
*G03G 15/16* (2006.01)
*G03G 15/20* (2006.01)

(52) U.S. Cl. ..... 399/307; 399/302

(58) Field of Classification Search ..... 399/307, 399/302, 308, 303, 313, 328, 329, 330, 333, 399/251; 492/18, 25, 46, 49, 53, 56
See application file for complete search history.

(56) References Cited

U.S. PATENT DOCUMENTS 3,945,726 A 3/1976 Ito et al.
3,975,096 A 8/1976 Opravil
3,995,589 A 12/1976 Salger
4,025,751 A 5/1977 Wright
4,071,735 A 1/1978 Moser
4,372,246 A 2/1983 Azar et al.
4,550,999 A 11/1985 Anderson
4,935,778 A 6/1990 Mochida
5,070,370 A 12/1991 Bellis
5,089,856 A 2/1992 Landa et al.
5,291,254 A 3/1994 Shimada et al.
5,339,147 A 8/1994 Snelling et al.
5,349,424 A 9/1994 Dalal et al.
5,384,630 A 1/1995 Nakamura et al.
5,394,232 A 2/1995 Tamura et al.
5,398,107 A 3/1995 Bartholmae et al.
5,450,183 A 9/1995 O'Leary
5,536,609 A 7/1996 Jackson et al.
5,581,293 A 12/1996 Wiklof
5,589,926 A 12/1996 Murasawa et al.
5,745,829 A 4/1998 Gazit et al.
5,784,677 A 7/1998 Tamura et al.

(Continued)

FOREIGN PATENT DOCUMENTS

JP 58083876 5/1983

(Continued)

OTHER PUBLICATIONS

Reeves Brothers, Inc., *Vulcan 714, The Original Compressible Blanket*, www.reevesbrothers.com, date unknown, Printing Products Group, Spartanburg, SC, USA.

(Continued)

*Primary Examiner*—Sophia S. Chen

(57) ABSTRACT

A printer includes a surface configured to carry an electrostatic charge and a printing material forming an image, a transfer member configured to carry printing material from the surface to media and a heater external to the transfer member. The heater is configured to heat printing material being carried by the transfer member.

47 Claims, 2 Drawing Sheets

U.S. PATENT DOCUMENTS

| | | | | |
|---|---|---|---|---|
| 5,815,783 | A | 9/1998 | Lior | |
| 6,002,907 | A * | 12/1999 | Berkes | 399/307 |
| 6,072,976 | A * | 6/2000 | Kuriyama et al. | 399/302 |
| 6,088,549 | A | 7/2000 | Kagawa et al. | |
| 6,141,026 | A | 10/2000 | Domoto | |
| 6,160,981 | A | 12/2000 | Williams et al. | |
| 6,173,147 | B1 * | 1/2001 | Nakashima et al. | 399/308 |
| 6,175,713 | B1 * | 1/2001 | Uehara et al. | 399/307 |
| 6,304,740 | B1 | 10/2001 | Ciaschi et al. | |
| 6,376,033 | B1 * | 4/2002 | Sonobe et al. | 399/307 X |
| 6,434,355 | B1 * | 8/2002 | Badesha et al. | 399/307 |
| 6,438,352 | B1 | 8/2002 | Landa et al. | |
| 6,442,366 | B1 | 8/2002 | Hartley et al. | |
| 6,456,816 | B1 * | 9/2002 | Chowdry et al. | 399/302 |
| 6,463,250 | B1 | 10/2002 | Chen et al. | |
| 6,512,912 | B2 | 1/2003 | Kamei et al. | |
| 6,551,716 | B1 | 4/2003 | Landa et al. | |
| 6,567,641 | B1 | 5/2003 | Aslam et al. | |
| 6,584,294 | B1 | 6/2003 | Landa et al. | |
| 6,611,670 | B2 | 8/2003 | Chen et al. | |
| 6,625,417 | B1 | 9/2003 | Terada et al. | |
| 6,673,407 | B2 * | 1/2004 | Hara et al. | 399/307 X |
| 6,687,482 | B2 | 2/2004 | Maeda et al. | |
| 6,785,501 | B2 * | 8/2004 | Hongawa et al. | 399/307 |
| 6,970,675 | B1 * | 11/2005 | Yoshino et al. | 399/307 |
| 2002/0172536 | A1 | 11/2002 | Hirst et al. | |
| 2003/0118381 | A1 * | 6/2003 | Law et al. | 399/307 |
| 2004/0126153 | A1 * | 7/2004 | Koga et al. | 399/307 |

FOREIGN PATENT DOCUMENTS

| | | |
|---|---|---|
| JP | 58085463 | 5/1983 |
| JP | 09015933 | 5/1997 |
| JP | 2001060044 | 7/2001 |
| JP | 2003-202731 A * | 7/2003 |
| WO | WO 01/06325 | 1/2001 |

OTHER PUBLICATIONS

European Search Report dated Dec. 22, 2006 for EP App. No. EP06110442, Hewlett-Packard (2 pages).

European Search Report dated Sep. 15, 2006 for EP patent application No. 06110442, 3 pages.

* cited by examiner

PRINTER TRANSFER MEMBER

BACKGROUND

Transfer members are used in printers to transfer printing material, such as toner, representing an image on an electrostatically charged surface to a print medium. The surfaces of such transfer members may be susceptible to being damaged during printing such as being permanently deformed by multiple sheets or thicknesses of media accidentally being brought into contact with the surface or by excessive heat at the surface.

DETAILED DESCRIPTION OF THE EXAMPLE EMBODIMENTS

Figure 1:
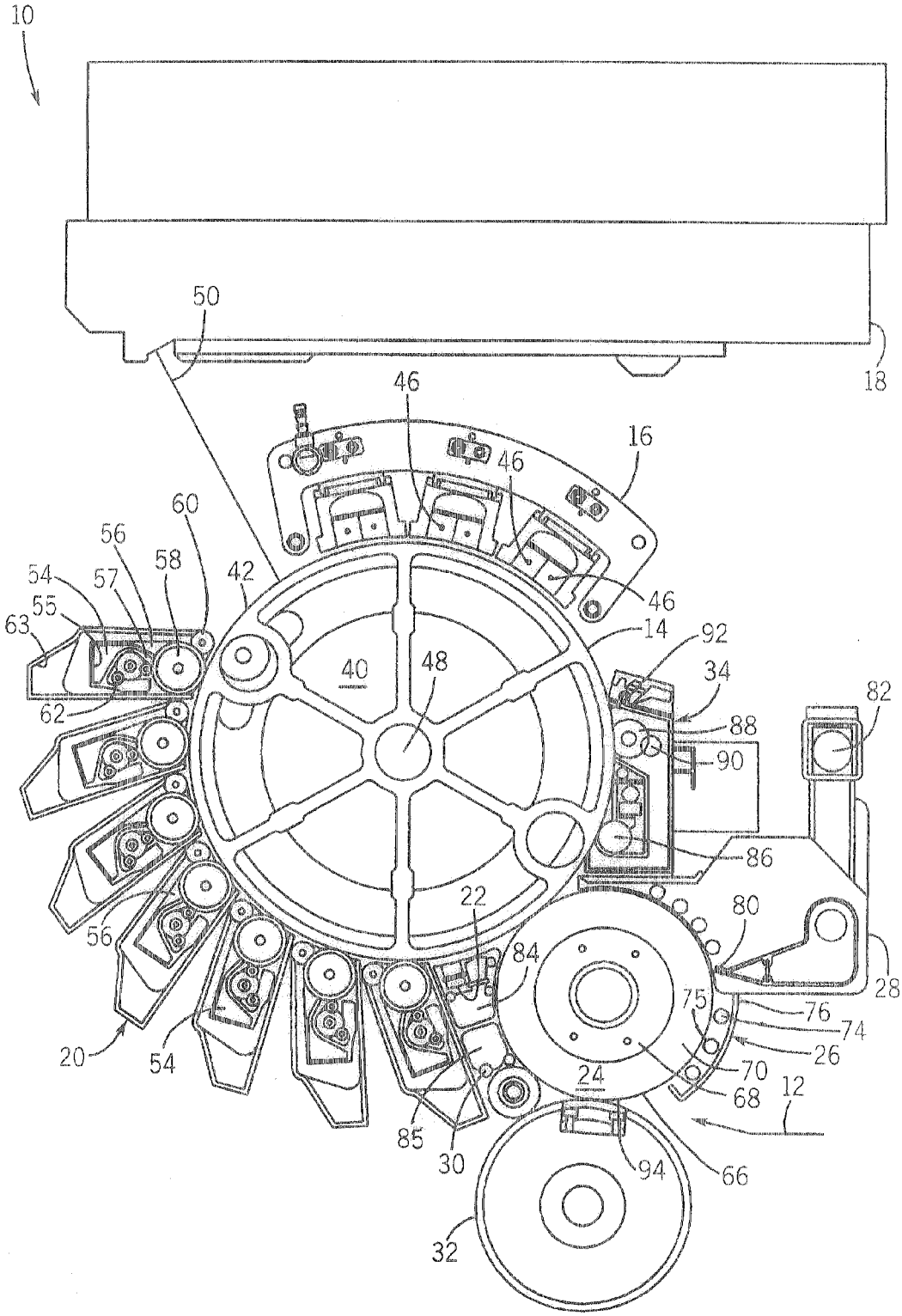
FIG. 1 is a sectional view schematically illustrating a printer including a transfer member according to one exemplary embodiment.

FIG. 1 is a schematic illustration of an imaging system or printer 10 configured to form an image upon a print medium 12 according to one exemplary embodiment. Printer 10, sometimes embodied as part of an offset color press, generally includes photoconductor 14, charger 16, imager 18, developer units 20, charge eraser 22, intermediate transfer member 24, external heating system 26, dryers 28, 30, impression member 32 and photoconductor cleaning station 34. Photoconductor 14 generally comprises a cylindrical drum 40 supporting an electro photographic surface 42, sometimes referred to as a photo imaging plate (PIP). Electro photographic surface 42 comprises a surface configured to be electrostatically charged and to be selectively discharged upon receiving light from imager 18. Although surface 42 is illustrated as being supported by drum 40, surface 42 may alternatively be provided as part of an endless belt supported by a plurality of rollers. In such an embodiment, the exterior surface of the endless belt may be configured to be electrostatically charged and to be selectively discharged for creating an electrostatic field in the form of an image.

Charger 16 comprises a device configured to electrostatically charge surface 42. In the particular example shown, charger 16 includes 6 corotrons or scorotrons 46. A more detailed description of the exemplary charger 16 may be found in U.S. Pat. No. 6,438,352, the full disclosure of which is hereby incorporated by reference. In other embodiments, other devices for electrostatically charging surface 42 may be employed.

Imager 18 generally comprises any device configured to direct light upon surface 42 so as to form an image. In the example shown, imager 18 comprises a scanning laser which is moved across surface 42 as photoconductor 14 is rotated about axis 48. Those portions of surface 42 which are impinged by the light or laser 50 become electrically conductive and discharge electrostatic charge to form an image (and latent image) upon surface 42.

Although imager 18 is illustrated and described as comprising a scanning laser, imager 18 may alternatively comprise other devices configured to selectively emit or selectively allow light to impinge upon surface 42. For example, in other embodiments, imager 18 may alternatively include one or more shutter devices which employ liquid crystal materials to selectively block light and to selectively allow light to pass through to surface 42. In other embodiments, imager 18 may alternatively include shutters which include individual micro or nano light-blocking shutters which pivot, slide or otherwise physically move between the light blocking and light transmitting states. Examples of such physical shutters described in co-pending U.S. patent application Ser. No. 10/916,690 filed on Aug. 12, 2004 by Dale R. KOPF et al. and entitled IMAGE-FORMING APPARATUS, the full disclosure of which is hereby incorporated by reference.

In still other embodiments, surface 42 may alternatively comprise an electrographic surface including an array of individual pixels configured to be selectively charged or selectively discharged using an array of switching mechanisms such as transistors or metal-insulator-metal (MIM) devices forming an active array or a passive array for the array of pixels. In such an embodiment, charger 16 may be omitted.

Developer units 20 comprise devices configured to apply printing material 54 to surface 42 based upon the electrostatic charge upon surface 42 and to develop the image upon surface 42. In the particular example shown, printing material 54 generally comprises a liquid or fluid ink comprising a liquid carrier and colorant particles. The colorant particles may have a size of less than 2 microns, although in different embodiments the particle size may be different. In the example illustrated, printing material 54 generally includes approximately 2% by weight, colorant particles or solids prior to being applied to surface 42. In one embodiment, the colorant particles include a toner binder resin comprising hot melt adhesive. In one particular embodiment, printing material 54 comprises HEWLETT-PACKARD ELECTRO INK commercially available from Hewlett-Packard.

Each developer unit 20 generally includes a toner chamber 55, a main electrode 56, a back electrode 57, a developer roller 58, a squeegee roller 60, a developer cleaning system 62 and a reservoir 63. Toner chamber 55 comprises a cavity having an inlet (not shown) through which printing material is supplied from reservoir 63 to chamber 55 and to between electrode 56 and developer roller 58. Main electrode 56 and back electrode 57 comprise members situated opposite to developer roller 58 and configured to be electrically charged. In the particular example shown, back electrode 57 has a dielectric tip opposite roller 58 and cooperates with electrode 56 to form toner chamber 55.

Developer roller 58 comprises a roller configured to be rotatably driven and electrically charged to a voltage distinct from the voltage of electrode 56 so as to attract electrically charged ink particles or colorant particles of printing material 54 as roller 58 is rotated. Roller 58 is charged such that the charged ink particles being carried by roller 58 are further attracted and drawn to those portions of surface 42 that are electrostatically charged. Squeegee roller 60 removes excess printing material 54 from the surface of roller 58. In particular embodiments, squeegee roller 60 may be selectively charged to control the thickness or concentration of printing material 54 upon the surface of roller 58. In the example shown, electrode 58 and squeegee roller 60 are appropriately charged so as to form a substantially uniform 6 micron thick film composed of approximately 20% solids on the surface of roller 58 which is substantially transferred to surface 42.

Developer cleaning system 62 removes printing material 54 from developer roller 58 which has not been transferred to surface 42. The removed printing material 54 is mixed and pumped back to a reservoir 63 which colorant particles or solid content of the liquid or fluid is precisely monitored and controlled. One particular example of a developer unit 20 may be found in U.S. Pat. No. 6,438,352, the full disclosure of which is hereby incorporated by reference.

Charge eraser 22 comprises a device situated along surface 42 and configured to remove residual charge from surface 42. In one embodiment, charge eraser 22 may comprise an LED erase lamp. In particular embodiments, eraser 22 may comprise other devices or may be omitted.

Intermediate transfer member 24 comprises a member configured to transfer printing material 54 from surface 42 to print medium 12. Intermediate transfer member 24 includes an exterior surface 66 which is resiliently compressible and which is configured to be electrostatically charged. Because surface 66 is resiliently compressible, surface 66 conforms and adapts to irregularities on print medium 12. Because surface 66 is configured to be electrostatically charged, surface 66 may be charged to a voltage so as to facilitate transfer of printing material 54 from surface 42 to surface 66. As will be described in greater detail hereafter, in some embodiments, surface 66 has a compressibility that may aid in reducing the likelihood of damage caused by permanent deformation of surface 66.

In the particular embodiment shown, intermediate transfer member 24 includes drum 68 and an external blanket 70 which provides surface 66. Drum 68 generally comprises a cylinder supporting blanket 70. In one embodiment, drum 68 is formed from one or more materials having a relatively low thermal conductivity and/or heat resistance. In one embodiment, drum 68 may be formed from one or more polymers. In other embodiments, the cylindrical wall of drum 68 may be formed from a metal such as aluminum.

Blanket 70 wraps about drum 68 and provides surface 66. In one particular embodiment, blanket 70 is adhered to drum 68. In one embodiment, blanket 70 is secured to drum 68 in direct contact with drum 68 without any intervening or intermediate thermal coupling elements such as thermal coupling compounds or thermal coupling adhesives which fill in air gaps, cavities or voids that may exist between blanket 70 and drum 68. In other embodiments, such thermal coupling elements may alternatively be provided between blanket 70 and drum 68. As will be described in greater detail hereafter, some embodiments of blanket 70 include one or more resiliently compressible layers and one or more electrically conductive layers, enabling surface 66 to conform and to be electrostatically charged. Although intermediate transfer member 24 is illustrated as comprising drum 68 supporting blanket 70 which provides surface 66, intermediate transfer member 24 may alternatively comprise an endless belt supported by a plurality of rollers in contact or in close proximity to surface 42 and compressible roller 32. In such an embodiment, the belt may have a configuration substantially similar to blanket 70.

Heating system 26 is external to surface 66 of intermediate transfer member 24 and is configured to apply heat to printing material 54 being carried by surface 66 from photoconductor 14 to media 12. In the example shown, heating system 26 is configured to apply sufficient heat to printing material carried by surface 66 so as to concentrate solids of printing material by at least partially or substantially driving off or evaporating carriers or solvents of the liquid printing material, such as Isopar. In the embodiment shown, heating system 26 is also configured to apply sufficient heat energy to the printing material 54 so as to partially melt and blend solids or colorant particles of printing material 54, forming a hot adhesive liquid plastic. Because heating system 26 is external to surface 66 of intermediate transfer member 24, heat applied by system 26 is directly transmitted to printing material 54, rather than having to pass through intermediate layers, increasing thermal efficiency. Because heating system 26 is external to surface 66 of intermediate transfer member 24, drum 68 may be formed from materials having relatively low thermal conductivity and/or heat resistance. Blanket 70 may also be provided with a greater thickness or improved conformance and may be made from fewer layers and less expensive materials having a lower heat resistance. As a result, surface 66 and blanket 70 are less susceptible to damage from permanent deformation caused by multiple sheets of media accidentally contacting surface 66 and are less susceptible to damage by excess heat at surface 66 resulting from thermal inertia.

In the particular embodiment illustrated, heating system 26 includes heaters 74 and housing 76. Heaters 74 comprise mechanisms configured to generate heat which is transmitted to printing material 54 on surface 66. In the particular example shown, heaters 74 comprise multiple infra-red heaters arranged about surface 66 between photoconductor 14 and impression member 32. Heaters 74 are specifically configured to heat printing material 54 upon surface 66 to a temperature of at least 85° C. nominally 90° and no greater than 110° C. In one example embodiment, heaters 74 may include two individual heaters circumferentially spaced from one another by 2 centimeters and radially spaced from surface 66 by 1 centimeter. In other embodiments, heaters 74 may comprise other heating mechanisms. For example, heaters 74 may alternatively comprise inductive heating devices 75' configured to emit or generate a magnetic field, causing a conductive layer, which is part of blanket 70 and proximate to surface 66, to have eddy currents and to be inductively heated so as to heat printing material 54 upon surface 66. The locations of the heaters shown and described herein are exemplary and may vary.

Housing 76 comprises one or more panels or walls extending partially about heaters 74. In particular embodiments, housing 76 may also partially support heaters 74. As shown by FIG. 1, housing 76 may also serve to house and provide a portion of dryer 28. Housing 76 serves as a heat shield and encloses or otherwise directs heat emitted by heaters 74 towards surface 66.

Dryers 28 and 30 comprise devices configured to facilitate partial drying of printing material 54 upon surface 66. Dryers 28 and 30 are arranged about intermediate transfer member 24 and configured to direct air towards surface 66 and to withdraw air from surface 66. In the particular example shown, dryer 28 forces air through exit slit 80 which forms an air knife and withdraws or sucks air via exit port 82. Similarly, dryer 30 forces air toward surface 66 via chamber 84 and sucks or withdraws air away from surface 66 via chamber 85. One specific example of dryers 28 and 30 may be found in U.S. Pat. No. 6,438,352, the full disclosure of which is hereby incorporated by reference. In other embodiments, other dryers or drying mechanisms may be employed or dryers 28 and 30 may be omitted.

Impression cylinder 32 comprises a cylinder adjacent to intermediate transfer member 24 so as to form a nip 94 between member 24 and cylinder 32. Media 12 is generally fed between intermediate transfer member 24 and impression cylinder 32, wherein printing material 54 is transferred from intermediate transfer member 24 to medium 12 at nip 94. Although impression member 32 is illustrated as a cylinder or roller, impression member 32 may alternatively comprise an endless belt or a stationary surface against which intermediate transfer member 24 moves.

Cleaning station 34 is arranged proximate to surface 42 between the intermediate transfer member 24 and charger 16. Cleaning station 34 comprises one or more devices configured to remove residual ink and electrical charge from surface 42. In particular examples shown, cleaning station 34 flows a cooled liquid, such as a carrier liquid, across surface 42 between rollers 86, 88. Adhered toner particles are removed by roller 88, which is absorbent. Particles and liquids picked up by the absorbent material of roller 88 is squeegeed out by a squeegee roller 90. The cleaning process of surface 42 is completed by station 34 using a scraper blade 92 which scrapes any remaining toner or ink from surface 42 and keeps the carrier liquid from leaving cleaning station 34. One specific example of cleaning station 34 may be found in U.S. Pat. No. 6,438,352, the full disclosure of which is hereby incorporated by reference. In other embodiments, other cleaning stations may be employed or cleaning station 34 may be omitted.

In operation, charger 16 electrostatically charges surface 42. Surface 42 is exposed to light from imager 18. In particular, surface 42 is exposed to laser 50 which is controlled by a raster image processor that converts instructions from a digital file into on/off instructions for laser 50. This results in a latent image being formed for those electrostatically discharged portions of surface 42. Ink developer units 20 develop an image upon surface 42 by applying ink to those portions of surface 42 that remain electrostatically charged. In the embodiment shown, printing material 54 contains approximately 2% solids of colorant particles prior to being applied to developer roller 58 of each developer unit 20. Printing material 54 has an approximately 6 micron thick film with approximately 20% solids on developer roller 58 prior to being applied to surface 42.

Once an image upon surface 42 has been developed, eraser 22 erases any remaining electrical charge upon surface 42 and the ink image is transferred to surface 66 of intermediate transfer member 24. In the embodiment shown, printing material 54 forms an approximately 1.4 micron thick layer of approximately 85% solids colorant particles with relatively good cohesive strength.

Heating system 26 applies heat to printing material 54 upon surface 66 so as to evaporate the carrier liquid of printing material 54 and to melt toner binder resin of the colorant particles or solids of printing material 54 to form a hot melted adhesive. Dryers 28 and 30 partially dry the melted liquid colorant particles. Thereafter, the layer of melted colorant particles forming an image upon surface 66 is transferred to media 12 passing between transfer member 24 and impression cylinder 32. In the embodiment shown, the melted colorant particles are transferred to print media 12 at approximately 90 degrees Celsius. The layer of melted colorant particles freeze to media 12 on contact in the nip formed between intermediate transfer member 24 and impression cylinder 32. Thereafter, any remaining printing material 54 on surface 42 is removed by cleaning station 34.

These operations are repeated for the various colors for preparation in the final image to be produced. In other embodiments, in lieu of creating one color separation at a time on surface 66, sometimes referred to as "multi-shot" process, the above-noted process may be modified to employ a one-shot color process in which all color separations are layered upon surface 66 of intermediate transfer member 24 prior to being transferred to and deposited upon medium 12.

Figure 2:
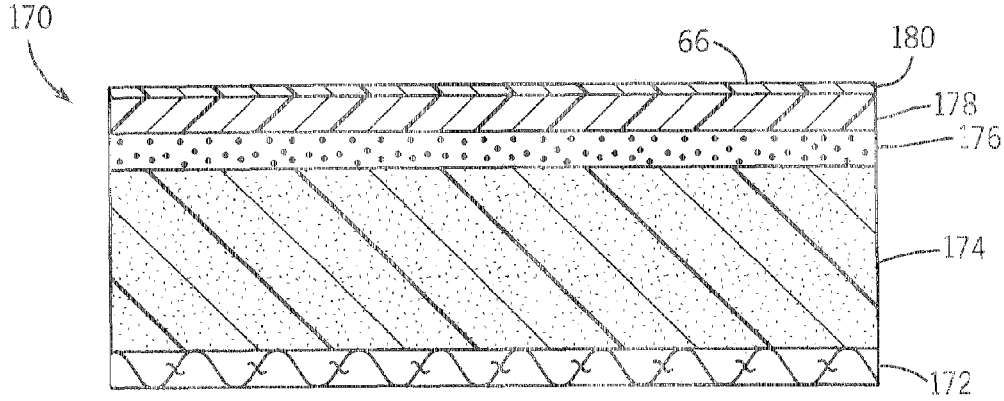
FIG. 2 is a sectional view of a blanket of the transfer member of FIG. 1 according to one exemplary embodiment.

FIG. 2 is a sectional view illustrating intermediate transfer member blanket 170, one embodiment of blanket 70 shown in FIG. 1. Blanket 170 is configured to be wrapped or otherwise secured about drum 68 (shown in FIG. 1). Blanket 170 generally includes layers 172, 174, 176, 178 and 180. Layer 172 generally comprises a layer of material having sufficient strength so as to function as a substrate upon which the remaining layers are formed. Layer 172 provides mechanical strength to the finished blanket 170 in addition to providing a starting substrate for the manufacturing process. In the particular example, layer 172 comprises one or more layers of fabric material. Because printing material 54 upon surface 66 of intermediate transfer 24 is heated using an external heating system 26, layer 172 may be formed from materials, such as fabrics, having a reduced heat resistance. The term "heat resistance" means that the material retains its mechanical characteristics such as tensile strength, elongation, hardness and tear resistance without substantial deterioration up to a desired temperature. In particular, materials having a heat resistance of at least 100 degrees Celsius may be used, permitting materials with a heat resistance of less than 150 degrees Celsius to be employed. In one embodiment, materials having a type rating of below D but greater than B per ASTM D20/SAE J200 may be used. For example, layer 172 may be formed from cotton or polyester, reducing the cost of blanket 170. In other embodiments, materials having higher heat resistivity may also be used.

In addition, layer 172 does not need to be thermally bonded or adhered to drum 68 (shown in FIG. 1). As a result, thermal adhesive may be omitted, reducing the cost of blanket 170. In other embodiments, heat resistant fabric material such as NOMEX, an aromatic, polyamid commercially available from DuPont, of Wilmington, Del., which chars at 420 degrees Celsius, may be employed.

In the particular example shown, layer 172 has a thickness of 250 micrometers. The fibers of layers 172 may be in the form of continuous filament, strand or yarn, as a mat, a structure of woven filaments. Examples of fiber materials include carbon, cotton boron, fiberglass, plastics, metals or alloys.

Layer 174 is coupled to layer 172 and is resiliently compressible. For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature.

Layer 174 includes one or more substantially adjacent layers of resiliently compressible cellular material, such as sponge material. The term "substantially adjacent" encompasses layers that directly contact one another or that directly contact one another but for extremely thin adhesive bonding layer disposed therebetween. Layer 174 provides a mechanical compliance for blanket 170 which typically has a thickness of at least about 500 micrometers. Nominally, in some embodiments, layer 170 has a thickness of at least about 800 micrometers. The thickness of layer 174 enables larger defects (abrupt changes in media thickness) be accommodated by blanket 170 before the elastic limit of layer 174 is reached, reducing the chance of permanent damage to blanket 170. In addition, the enlarged thickness of layer 174 provides a nip 94 (shown in FIG. 1) of the same length, but with a lower transfer force which decreases seam banding, a leading print quality dissatisfier. Furthermore, the increased thickness of layer 174 also allows a larger nip 66 to enhance adhesion to the print media.

Layer 174 may be formed from cellular materials and may impart increased compressibility to blanket 170. The cellular material may include open cells or may include closed cells formed with the use of microspheres. In one embodiment, layer 174 is formed by spread coating, calendaring, dipping or otherwise contacting layer 172 with a matrix material which includes microspheres. Suitable matrix materials include plastic and thermosetting resins, polyurethanes and natural synthetic elastomers. Elastomeric materials include acrylonitrile, acrylic rubber, silicon rubber or an elastomer or plastic made from fluorocarbon material. Particular suitable elastomers include hydrogenated nitrile, nitrile or acrylic rubbers applied to layer 172 by a solvent carrier. Microspheres may be formed from materials such as thermoplastic resins, thermosetting resins, ceramics, glass and sintered metals. One example of a thermosetting resin for forming microspheres is a phenolic resin having a density of between about 0.01 and 0.05 grams per cubic centimeter. The microspheres range in diameter between 1 to 200 and nominally 50 to 130 microns. Such microspheres are disbursed relatively uniformly throughout the matrix material.

According to one embodiment, layer 174 is formed by applying a number of thin layers of about 0.002 millimeters in successive applications to layers 172. Microspheres are incorporated into the elastomeric material at a loading of about 4% to 90% and nominally of between about 10% to 70% of the solid contents. As a result, the microspheres are uniformly distributed throughout the elastomer so as to avoid appreciable crushing of the microspheres. Examples of microspheres are found in U.S. Pat. No. 5,754,931, the full disclosure of which is hereby incorporated by reference.

In other embodiments, cells may be formed in the matrix of layer 174 by leeching or by blowing (mechanically inducing air or other gas into the material) before it is applied to layer 172. Mechanical introduction of air or other gas into the matrix of layer 174 may be performed by aerating, stirring or other means. In still other embodiments, cells may be created using chemical blowing agents or foaming agents that are decomposable into gases as they are cured in a compound. One example of a class of blowing agents is CELLOGENS manufactured by Uni-Royal. Other types of blowing agents utilized to form cells within layer 174 are found in U.S. Pat. No. 5,754,931 and U.S. Pat. No. 4,548,858, the full disclosures of which are hereby incorporated by reference.

In still another embodiment, layer 174 may be separately formed and adhered to layer 172. Examples of adhesives that may be used to bond layer 174 to layer 172 include a compounded nitrile rubber or a variety of water and solvent based elastomeric adhesives.

Because printing material 54 is heated upon surface 66 of transfer member 24 by external heating system 26 (shown in FIG. 1) or a heating system proximate to surface 66 (such as by an inductive heating arrangement), layer 174 may be formed from polymeric materials having a reduced heat resistance. In particular, materials having a heat resistance of at least 100 degrees Celsius may be used, permitting materials with a heat resistance of less than 150 degrees Celsius to be employed. In one embodiment, materials having a type rating of below D but greater than B per ASTM D2000/SAE J200 may be used. For example, layer 174 may be formed from one or more materials such as nitrile rubber (NBR), which are generally less expensive materials instead of higher heat resistant materials such as hydrogenated nitrile rubber (HNBR). As a result, the manufacturing costs of blanket 170 are reduced. In other embodiments, other polymeric materials or materials having a higher heat resistance may be used.

Layer 176 comprises one or more substantially adjacent layers of electrically conductive material which may be electrically connected to a voltage source. In the example shown, layer 176 extends generally adjacent to layer 174 and has a thickness of approximately 100 micrometers. Layer 176 generally has a resistance of less than about 2.5 kilo ohms per square inch. In general, the resistance of layer 176 may be low enough so that current flowing on layer 176 will not cause a substantial variation of voltage along the surface of blanket 170. Resistance of layer 176 and the resistance of an overlying layers including layers 178 and 180, control current flowing through the overlying layers. Layer 176 facilitates the creation of electrostatic charge along surface 66 to transfer printing material 54 from surface 42 (shown in FIG. 1). In one particular embodiment, layer 178 may be formed from a polymeric material or rubber, such as nitrile rubber, including conductive carbon black or metal fibers.

Layer 178 comprises one or more substantially adjacent layers of resiliently compressible non-cellular materials substantially adjacent to layer 176. Layer 178, sometimes referred to as a compliant or resilient layer, provides local compliance such that printing material 54 is transferred to all surfaces of print media 12 at nip 94 (shown in FIG. 1). Layer 178 also provides a chemically favorable substrate for the coating of layer 180. As compared to layer 180, layer 178 is generally thicker, is formed from a material having a greater surface energy than the material of layer 180 and is generally less expensive than the material of layer 180. Layer 178 is, in some example embodiments, spaced from surface 66 by a distance no greater than 20 micrometers. In the particular example shown, layer 178 is spaced from surface 66 by approximately 5 micrometers.

In the particular example illustrated, layer 178 is formed from the same material or materials as layer 174 while omitting cells or voids. In one embodiment, layer 178 is formed from nitrile rubber and has a thickness of approximately 100 micrometers. In other embodiments, layer 178 may be formed from other resiliently compressible non-cellular materials and may have other thicknesses.

Layer 180 generally comprises one or more substantially adjacent layers of materials configured to release printing material 54 to media 12 at nip 94 (shown in FIG. 1). Layer 180 provides blanket 170 with an exterior surface having a surface energy less than the surface energy of media 12 to facilitate the transfer of printing material 54 from the exterior surface of blanket 170 to media 12 at nip 94. Layer 180, sometimes referred to as a release layer, typically has a thickness of less than 20 micrometers. In the particular example shown, layer 180 has a thickness of approximately 5 micrometers. Examples of materials from which release layer 180 may be formed include silicone rubber. Another example of material for release layer 180 is the release layer material and formation process as described in U.S. Pat. No. 6,584,294, the full disclosure of which is hereby incorporated by reference.

Overall, blanket 170 is more durable, less complex and is less expensive. Because layer 174, in some embodiments, has an increased thickness of at least 500 micrometers and nominally at least 800 micrometers, blanket 170 accommodates larger print medium variations without damage or permanent deformation of blanket 170. The increased thickness of layer 174 further allows the same size nip with a lower transfer force, decreasing seam banding. Because blanket 170 may omit thermal coupling to drum 68 (shown in FIG. 1), the use of adhesive for bonding blanket 170 to drum 68 may be eliminated, reducing cost, facilitating easier and faster changing of blanket 170. Moreover, because blanket 170 utilizes materials that have a lower heat resistance and are less expensive, blanket 170 is also less expensive.

Figure 3:
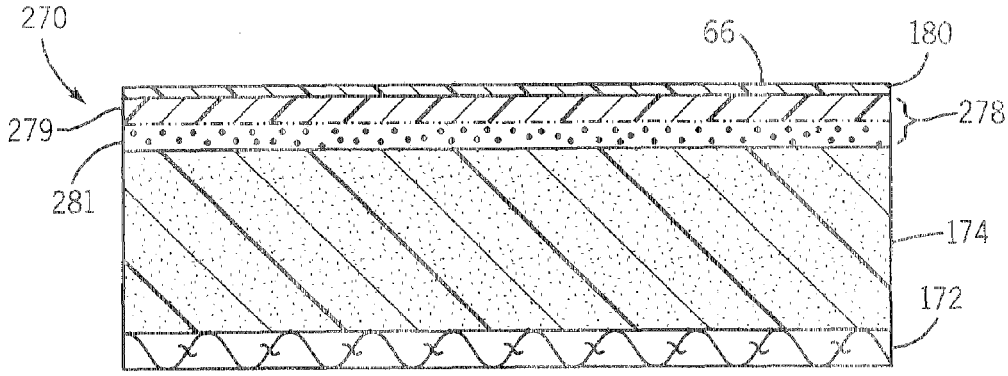
FIG. 3 is a sectional view of another embodiment of a blanket of the transfer member of FIG. 1 according to one exemplary embodiment.

FIG. 3 is a sectional view of blanket 270, another embodiment of blanket 170. Blanket 270 is similar to blanket 170 except that blanket 270 eliminates layer 176 and includes layer 278 in lieu of layer 178. The remaining layers of blanket 270 which are similar to the corresponding layers of blanket 170 are similarly numbered. Layer 278 is similar to layer 178 except that layer 278 is electrically conductive. As with layer 176 of blanket 170, the electrical conductivity of layer 278 enables layer 278 to be electrically coupled to a voltage source to create an electrostatic charge along surface 66 for adherence of printing materials to surface 66. In particular, layer 278 comprises one or more substantially adjacent layers of resiliently compressible non-cellular electrically conductive material substantially adjacent to layer 174 and layer 180. In one embodiment, layer 278 may be electrically conductive by the incorporation of electrically conductive carbon black or electrically conductive metal fibers. According to one embodiment, layer 178 comprises nitrile rubber in which is incorporated electrically conductive carbon black. Layer 278 has an electrical resistance of no greater than 50 Kohm/square inch. Layer 278 is spaced from surface 66 by no greater than 20 micrometers and by a nominal distance of 5 micrometers.

In one embodiment, layer 278 is formed by applying multiple coatings or layers directly upon layer 174. For example, in one embodiment, the first portion 279 of the coatings may be formed from a material including electrically conductive elements such as electrically conductive carbon black or metal fibers, while the second portion 281 of the coatings may be formed from the same material, such as nitrile rubber, but excluding the electrically conductive elements so as to be electrically insulating. Because layer 278 is coated directly on compressible layer 174, the fabrication of blanket 270 is simpler and less expensive. Moreover, because blanket 270 eliminates layer 176, the fabrication of blanket 270 is further simplified to reduce manufacturing costs. In other embodiments, layer 278 is separately formed with release layer 180 and laminated to layer 174.

Figure 4:
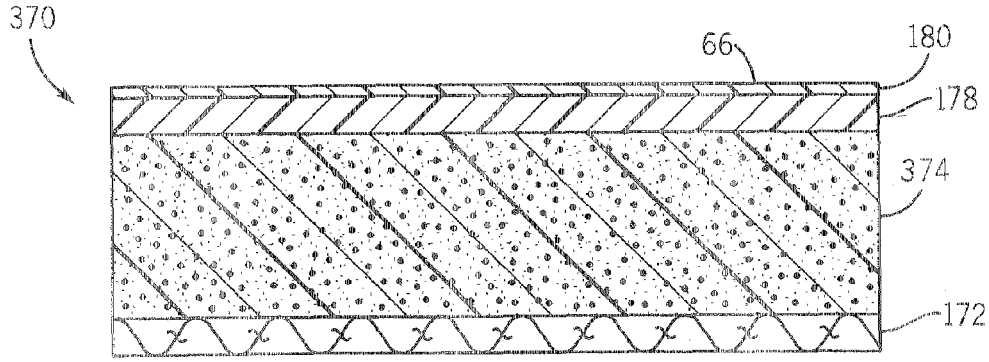
FIG. 4 is a sectional view of another embodiment of a blanket of the transfer member of FIG. 1 according to one exemplary embodiment.

FIG. 4 illustrates blanket 370, another embodiment of blanket 170. Blanket 370 is similar to blanket 170 except that blanket 370 eliminates layer 176 and includes layer 374 in lieu of layer 174. Those remaining layers of blanket 370 which correspond to layers of blanket 170 are similarly numbered.

Layer 374 is similar to layer 174 except that layer 374 is electrically conductive. As with layer 176 of blanket 170, the electrical conductivity of layer 374 enables layer 374 to be electrically coupled to a voltage source to create an electrostatic charge along surface 66 for adherence of printing materials to surface 66. In the particular example shown, layer 374 has an electrical resistance of no greater than 50 Kohm/square inch. In the particular example shown, layer 374 is made electrically conductive by the incorporation of electrically conductive carbon black or metal fibers. In the particular example shown, layer 374 is spaced from surface 66 by a distance no greater than 200 micrometers and nominally by approximately 105 micrometers. Because layer 374 is electrically conductive so as to eliminate the need for layer 176, blanket 370 is simpler and less expensive to manufacture.

Like blanket 170, blankets 270 and 370 are more durable, less complex and less expensive. Because layers 174 and 274 have increased thicknesses of at least 500 micrometers and nominally at least 800 micrometers. Blankets 270 and 370 accommodate larger print medium variations without damage or permanent deformation. The increased thicknesses further allow the same or larger nip with a lower transfer force, decreasing seam banding. Because blankets 270 and 370 may omit thermal coupling to drum 68 (shown in FIG. 1), the use of adhesive for bonding the blankets to drum 68 may be eliminated, reducing costs and facilitating easier and faster changing of the blanket. Moreover, blankets 270 and 370 utilize fewer materials that have a lower heat resistance, reducing the cost of such blankets.

Although the present invention has been described with reference to example embodiments, workers skilled in the art will recognize that changes may be made in form and detail without departing from the spirit and scope of the invention. For example, although different example embodiments may have been described as including one or more features providing one or more benefits, it is contemplated that the described features may be interchanged with one another or alternatively be combined with one another in the described example embodiments or in other alternative embodiments. Because the technology of the present invention is relatively complex, not all changes in the technology are foreseeable. The present invention described with reference to the example embodiments and set forth in the following claims is manifestly intended to be as broad as possible. For example, unless specifically otherwise noted, the claims reciting a single particular element also encompass a plurality of such particular elements.

What is claimed is:

1. A printer comprising:

a surface configured to carry an electrostatic charge and a printing material forming an image;

a transfer member configured to carry printing material from the surface to media; and a heater external to the transfer member and configured to heat printing material being carried by the transfer member; and a low temperature fabric layer having a heat resistance of less than 150 degrees Celsius and having a type rating of between B and up to D per ASTM D2000.

2. The printer of claim 1, wherein the transfer member includes an electrically conductive layer configured to be electrically charged.

3. The printer of claim 1, wherein the transfer member includes one or more adjacent cellular layers having a total thickness of at least 500 micrometers.

4. The printer of claim 3, wherein the one or more adjacent cellular layers includes at least one sponge layer.

5. The printer of claim 1, wherein the transfer member includes one or more adjacent cellular layers having a total thickness of at least 800 micrometers.

6. The printer of claim 5, wherein the one or more adjacent cellular layers includes at least one sponge layer.

7. The printer of claim 1, wherein the transfer member includes one or more adjacent cellular layers, and wherein at least one of the cellular layers is electrically conductive.

8. The printer of claim 1, wherein the transfer member includes:

a cellular layer;

a release layer; and a non-cellular electrically conductive resilient layer between the release layer and the cellular layer.

9. The printer of claim 8, wherein the non-cellular electrically conductive resilient layer is less than 20 micrometers from an outer surface of the transfer member.

10. The printer of claim 8, wherein the non-cellular electrically conductive resilient layer is adjacent the release layer.

11. The printer of claim 1, wherein the heater includes an infrared heating element.

12. The printer of claim 1, wherein the heater is configured to inductively heat the transfer member.

13. The printer of claim 1, wherein the transfer member has a surface and includes:

a cellular layer;

a non-cellular resilient layer adjacent the cellular layer and between the surface and the cellular layer, wherein the non-cellular layer is less than 20 micrometers from the surface and wherein at least one of the cellular layer and the non-cellular resilient layer is electrically conductive.

14. The printer of claim 1, wherein the transfer member is cylindrical.

15. The printer of claim 1, wherein the transfer member includes:

a drum; and a blanket extending about the drum.

16. The printer of claim 15, wherein the drum is non-metallic.

17. The printer of claim 15, wherein the blanket is in direct contact with the drum without an intermediate thermal coupling element.

18. The printer of claim 1, wherein the transfer member includes a low temperature polymeric layer.

19. The printer of claim 18, wherein the polymeric layer has a heat resistance of less than 150 degrees Celsius.

20. The printer of claim 18, wherein the polymeric layer has a temperature resistance of at least type B and less than type D per ASTM D2000.

21. The printer of claim 1, wherein the fabric layer is selected from a group of materials including cotton, polyester or blends thereof.

22. The printer of claim 1, wherein the transfer member includes a compressible layer of nitrile butadiene rubber (NBR).

23. The printer of claim 1, wherein the transfer member includes an electrically conductive layer including nitrile butadiene rubber (NBR).

24. The printer of claim 1, wherein the transfer member includes a compliant layer including nitrile butadiene rubber (NBR).

25. A transfer member comprising:

one or more adjacent cellular layers, the layers having a total thickness of at least 500 micrometers, wherein at least a portion of the transfer member is electrically conductive; and a lower temperature polymeric layer, wherein the polymeric layer has a heat resistance of at least type B and less than type D per ASTM D2000.

26. The transfer member of claim 25, wherein the one or more adjacent cellular layers includes at least one sponge layer.

27. The transfer member of claim 25, wherein the one or more adjacent cellular layers have a total thickness of at least 800 micrometers.

28. The transfer member of claim 27, wherein the one or more adjacent cellular layers include at least one sponge layer.

29. The transfer member of claim 25 including:

a release layer; and a non-cellular electrically conductive resilient layer between the release layer and the one or more adjacent cellular layers.

30. The transfer member of claim 29, wherein the non-cellular electrically conductive resilient layer is no greater than 200 micrometers from an outer surface of the transfer member.

31. The transfer member of claim 29, wherein the non-cellular electrically conductive resilient layer is adjacent to the release layer.

32. The transfer member of claim 31, wherein the non-cellular electrically conductive resilient layer is adjacent the one or more adjacent cellular layers.

33. The transfer member of claim 25 including a low temperature fabric layer.

34. The transfer member of claim 33, wherein the low temperature fabric layer is selected from a group of materials including cotton, polyester or blends thereof.

35. The transfer member of claim 33, wherein the fabric layer has a heat resistance of less than 150 degrees Celsius.

36. The transfer member of claim 33, wherein the fabric layer has a heat resistance of at least type B and less than type D per ASTM D2000.

37. The transfer member of claim 25, wherein the polymeric layer has a heat resistance of less than 150 degrees Celsius.

38. The transfer member of claim 25, wherein the transfer member includes a non-metallic drum about which the one or more adjacent cellular layers extend.

39. The transfer member of claim 25, wherein the transfer member has a surface that includes a non-cellular resilient layer adjacent to the one or more cellular layers, between the surface and one or more cellular layers and no greater than 200 micrometers from the surface, wherein at least one or more cellular layers and the non-cellular resilient layer is electrically conductive.

40. The transfer member of claim 25 further including a drum about which the one or more adjacent cellular layers extend.

41. The transfer member of claim 40, wherein the drum is non-metallic.

42. The transfer member of claim 40 including a fabric layer coupled to the cellular layers and in direct contact with the drum without any intermediate thermal coupling element.

43. A method for forming an image on a medium, the method comprising:

forming an electrostatic charge on a surface;

applying printing material to the surface based upon the charge on the surface;

electrostatically charging a surface of a transfer member;

transferring the printing material to the transfer member;

externally heating the printing material on the transfer member; and transferring the printing material to a print medium, wherein forming an electrostatic charge on the surface of the transfer member includes electrically charging a cellular resilient electrically conductive layer adjacent a non-cellular resilient layer no greater than 200 micrometers from the surface.

44. The method of claim 43, wherein the transfer member has a cellular resilient layer having a thickness of at least 500 micrometers.

45. The method of claim 43, wherein the transfer member includes a first layer and a second layer external to the first layer and wherein the second layer is heated to a temperature greater than the first layer.

46. A printer comprising:

a surface configured to carry an electrostatic charge and a printing material forming an image;

a transfer member configured to carry printing material from the surface to media; and a heater external to the transfer member and configured to heat printing material being carried by the transfer member; and a low temperature polymeric layer having temperature resistance of at least type B and less than type D per ASTM D2000.

47. A transfer member comprising:

one or more adjacent cellular layers, the layers having a total thickness of at least 500 micrometers, wherein at least a portion of the transfer member is electrically conductive; and a low temperature fabric layer having a heat resistance of at least type B and less than type D per ASTM D2000.

* * * * *

UNITED STATES PATENT AND TRADEMARK OFFICE

CERTIFICATE OF CORRECTION

PATENT NO. : 7,274,902 B2
APPLICATION NO. : 11/093466
DATED : September 25, 2007
INVENTOR(S) : Clayton L. Holstun et al.

It is certified that error appears in the above-identified patent and that said Letters Patent is hereby corrected as shown below:

On the title page, item (75), under "Inventors", in column 1, line 3, delete "Mark" and insert -- Marc --, therefor.

In column 4, line 37, delete "75'" and insert -- 75 --, therefor.

In column 6, line 27, delete "D20/SAE" and insert -- D2000/SAE --, therefor.

Signed and Sealed this

Fifth Day of August, 2008

JON W. DUDAS
*Director of the United States Patent and Trademark Office*